US006672099B1

(12) United States Patent
Yoshimi et al.

(10) Patent No.: US 6,672,099 B1
(45) Date of Patent: Jan. 6, 2004

(54) REFRIGERATION SYSTEM

(75) Inventors: Manabu Yoshimi, Sakai (JP); Chun-cheng Piao, Sakai (JP); Ryuichi Sakamoto, Sakai (JP); Yuji Watanabe, Sakai (JP); Kazuo Yonemoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/069,733

(22) PCT Filed: Aug. 24, 2000

(86) PCT No.: PCT/JP00/05726

§ 371 (c)(1),
(2), (4) Date: Feb. 28, 2002

(87) PCT Pub. No.: WO01/18467

PCT Pub. Date: Mar. 15, 2001

(30) Foreign Application Priority Data

Sep. 3, 1999 (JP) ..... 11-249721

(51) Int. Cl.[7] ..... F25B 39/02; F28C 1/00

(52) U.S. Cl. ..... 62/467; 62/516; 62/315

(58) Field of Search ..... 62/467, 515, 516, 62/517, 304, 309, 315; 261/101, 100, DIG. 3

(56) References Cited

U.S. PATENT DOCUMENTS 3,197,973 A * 8/1965 Rannenberg et al. ..... 62/268
5,946,931 A * 9/1999 Lomax et al. ..... 62/304

FOREIGN PATENT DOCUMENTS

| | | |
|---|---|---|
| DE | 195 45 335 A1 | 6/1997 |
| DE | 197 67 769 A1 | 6/1999 |
| EP | 0 532 368 A2 | 3/1993 |
| JP | 58-11083 | 1/1983 |
| JP | 2-59394 | 12/1990 |
| JP | 4-090471 | 3/1992 |
| JP | 6-257890 | 9/1994 |
| JP | 5-66078 | 3/1999 |
| JP | 11-218371 | 8/1999 |

* cited by examiner

*Primary Examiner*—Chen Wen Jiang
(74) *Attorney, Agent, or Firm*—Nixon Peabody LLP; Donald R. Studebaker

(57) ABSTRACT

In a refrigeration system (10), an evaporator (11) and a condenser (15) are each formed of a container-like member (55). The inside of the container-like member (55) is divided into a liquid side space (12, 16) and a gas side space (13, 17) by a moisture permeable membrane (14, 18). Both the gas side spaces (13, 17) are held in a predetermined reduced-pressure condition. Both the liquid side spaces (12, 16) are placed in an atmospheric pressure condition. Water vapor provided by evaporation of water in the liquid side space (12) of the evaporator (11) passes through the moisture permeable membrane (14) and moves to the gas side space (13). The water vapor in the gas side space (13) is sucked by a compressor (21) so as to be pumped to the gas side space (17) of the condenser (15). In the condenser (15), the water vapor in the gas side space (17) moves to the liquid side space (16) and then condensates therein.

16 Claims, 12 Drawing Sheets

REFRIGERATION SYSTEM

TECHNICAL FIELD

This invention relates to a refrigeration system for effecting cooling by evaporation of water or heating by condensation of water vapor.

BACKGROUND ART

A heat pump is conventionally known which effects cooling and heating with the use of evaporation and condensation of water, as disclosed in Japanese Unexamined Patent Publication 6-257890.

In its cooling operation, the heat pump supplies a water to a vacuum container held in a reduced-pressure condition (for example, at about 4 to 5 mmHg), and generates a cold water by allowing the water stored in the vacuum container to voluntarily evaporate. The generated cold water is raised in pressure to the atmospheric pressure by a pump, taken out of the vacuum container and used for cooling.

In its heating operation, the heat pump supplies a water heat-exchanged with a water of heat source to the vacuum container and evaporates it therein. The water vapor in the vacuum container is compressed by a compressor, and pumped to a condenser. The water vapor has a lower pressure than the atmospheric pressure even after compressed. Water circulates through a flow passage of the condenser. The water inside of the flow passage is heat-exchanged with the water vapor outside of the flow passage, and thereby heated with heat of condensation of the water vapor. The generated hot water is used for heating.

Problems to be Solved

In this case, if the water stored in the vacuum container is merely evaporated, evaporation of water occurs only in the water surface area in the vacuum container. Therefore, in order to enhance evaporation in the vacuum container, it is necessary to upsize the vacuum container to extend the water surface area. Since the vacuum container requires high pressure resistance, however, it is extremely disadvantageous in terms of fabrication cost to upsize the vacuum container. To cope with this problem, in the heat pump as described above, attempt is made to enhance evaporation by spreading water inside of the vacuum container. In this manner, however, the water surface area is slightly extended by disturbance, which is not sufficient to enhance evaporation.

Also, in the above heat pump, a cold water in the vacuum container is extracted by raising the pressure thereof with a pump for the purpose of application of the generated cold heat. Pumping up the cold water from the vacuum container in reduced-pressure condition, however, is likely to cause cavitation inside of the pump, because the inside of the vacuum container is under extremely low pressure as described above. Therefore, the above heat pump has a problem in that the pump is damaged due to cavitation thereby providing deteriorated reliability.

As an approach to the above problem, it can be contemplated to provide a heat transfer pipe inside of the vacuum container, channel a water through the heat transfer pipe, cool the water inside of the pipe with a cold water outside of the pipe, and thereby extract cold heat. In fact, however, it is difficult to cool the water inside of the pipe down to the same temperature as that of the cold water outside of the pipe. This presents another problem that cold heat cannot sufficiently be extracted from the water inside of the pipe.

Further, the above problem is also created when hot heat is extracted in the condenser. Specifically, even when the condenser is provided with a flow passage and a water inside of the flow passage is heated up with water vapor outside thereof, as is the case with the above heat pump, there is a problem that hot heat cannot sufficiently be extracted due to heat loss during heat exchange.

There is conventionally known a moisture permeable membrane which does not permeate water as a liquid but can permeate water vapor as a gas. No application of a moisture permeable membrane of such kind for the condenser has been found. Accordingly, the appearance of a novel system using such a moisture permeable membrane would be desirable.

The present invention has been made in view of the foregoing points, and an object thereof is, in a refrigeration system using phase changes of water, to provide a downsized evaporator for evaporating water under reduced pressure, enhance reliability by facilitating the extraction of cold heat from the evaporator, and apply a moisture permeable membrane for a condenser.

DISCLOSURE OF INVENTION

A first solution taken in the invention is directed to a refrigeration system for cooling a heat transfer medium by evaporating water of the heat transfer medium in an evaporator (11). Further, the system is provided with: the evaporator (11) which is formed of a container-like member (55) having an inner space divided into a liquid side space (12) and a gas side space (13) by a moisture permeable membrane (14) capable of permeating water vapor, the liquid side space (12) being filled with the heat transfer medium which is water or water solution; and evacuating means (20) for evacuating from the gas side space (13) water vapor which has been provided by evaporation of water from the heat transfer medium in the liquid side space (12) of the evaporator (11) and has moved to the gas side space (13), and for holding the gas side space (13) into a predetermined reduced-pressure condition.

In a second solution taken in the invention, the refrigeration system in the first solution further includes a condenser (15) which is formed of a container-like member (55) and arranged to allow the water vapor evacuated from the evaporator (11) by the evacuating means (20) to flow into a gas side space (17) thereof and then move from the gas side space (17) to a heat transfer medium with which a liquid side space (16) thereof is filled.

A third solution take in the invention is directed to a refrigeration system which is provided with: an evaporator (11) in which a heat transfer medium of water or water solution is stored; evacuating means (20) for evacuating water vapor provided by evaporation of water from the heat transfer medium inside of the evaporator (11) and for holding the evaporator (11) in a predetermined reduced-pressure condition; and a condenser (15) formed of a container-like member (55) an inner space of which is divided into a liquid side space (12) and a gas side space (13) by a moisture permeable membrane (14) capable of permeating water vapor, the condenser (15) being arranged to move the water vapor admitted into a gas side space (17) thereof by the evacuating means (20) to a heat transfer medium with which a liquid side space (16) thereof is filled.

In a fourth solution taken in the invention, the refrigeration system in the second or third solution is arranged to effect a heat pumping operation of using heat released from the water vapor in the condenser (15) to heat the heat transfer medium.

In a fifth solution taken in the invention, the refrigeration system in any one of the first to fourth solutions is arranged so that the evacuating means (20) comprises a compressor (21) for compressing the water vapor sucked from the evaporator (11) and pumping the water vapor into the condenser (15).

In a sixth solution taken in the invention, the refrigeration system in any one of the first to fourth solutions is arranged so that the evacuating means (20) comprises an absorbing medium for absorbing and releasing moisture, allows the absorbing medium to absorb the water vapor from the evaporator (11) and sends into the condenser (15) the water vapor released from the absorbing medium.

In a seventh solution taken in the invention, the refrigeration system in any one of the first to fourth solutions is arranged so that the evacuating means (20) includes water vapor generating means (115) for generating water vapor through the application of heat and an ejector (110) for ejecting water vapor from the evaporator (11) under the action of a jet of the water vapor generated by the water vapor generating means (115).

In an eighth solution taken in the invention, the refrigeration system in any one of the first to seventh solutions is arranged so that the container-like member (55) contains a multiplicity of moisture permeable tubes (60) each formed of a moisture permeable membrane (14, 18), the inside of the moisture permeable tube (60) is formed into a liquid side space (12, 16) and the outside of the moisture permeable tube (60) is formed into a gas side space (13, 17).

In a ninth solution taken in the invention, the refrigeration system in any one of the first to eighth solutions is arranged so that the moisture permeable membrane (14, 18) in the container-like member (55) has a surface which is presented to the gas side space (13, 17) and covered with a porous film (61).

In a tenth solution taken in the invention, the refrigeration system in any one of the first to ninth solutions is arranged so that the moisture permeable membrane (14, 18) in the container-like member (55) has water repellency.

In an eleventh solution taken in the invention, the refrigeration system in any one of the first to tenth solutions is arranged so that the evaporator (11) cools the heat transfer medium to generate a frozen product slurry.

In a twelfth solution taken in the invention, the refrigeration system in the eleventh solution is arranged to include a heat storage tank (67) and effect a heat storage operation of storing in the heat storage tank (67) the frozen product generated by the evaporator (11).

In a thirteenth solution taken in the invention, the refrigeration system in any one of the two to tenth solutions is arranged to include a heat storage tank (67) and effect a heat storage operation of storing in the heat storage tank (67) the heat transfer medium cooled by the evaporator (11) and a heat utilization operation of cooling the heat transfer medium in the evaporator (11) and supplying to the condenser (15) the heat transfer medium stored in the heat storage tank (67) through the heat storage operation to condense water vapor.

In a fourteenth solution taken in the invention, the refrigeration system in any one of the first to tenth solutions further includes: a heat storage tank (67) connected to the evaporator (11) to allow the heat transfer medium to circulate between the evaporator (11) and the heat storage tank (67); and heat utilization means (32) to which the heat transfer medium is supplied from the evaporator (11), and the system is arranged to effect a heat storage operation of storing in the heat storage tank (67) the heat transfer medium cooled by the evaporator (11) and a heat utilization operation of supplying to the evaporator (11) the heat transfer medium stored in the heat storage tank (67) through the heat storage operation and supplying to the heat utilization means (32) a frozen product slurry produced by cooling the heat transfer medium.

In a fifteenth solution taken in the invention, the refrigeration system in any one of the two to tenth solutions further includes: a heat utilization side heat exchanger (32) for heat exchanging the heat transfer medium with an object to be cooled; and a cooling tower (90) for cooling the heat transfer medium, and the system is arranged to effect a first cooling operation of circulating the heat transfer medium between the cooling tower (90) and the condenser (15), circulating the heat transfer medium between the heat utilization side heat exchanger (32) and the evaporator (11) and operating the evacuating means (20) and effect a second cooling operation of circulating heat transfer medium between the cooling tower (90) and the heat utilization side heat exchanger (32) and stopping the evacuating means (20).

Operations

In the first solution, the evaporator is formed of a container-like member (55). The liquid side space (12) of the container-like member (55) as the evaporator (11) is filled with a heat transfer medium. The gas side space (13) is held at a predetermined pressure lower than the atmospheric pressure by the evacuating means (20). Namely, in the evaporator (11), only the gas side space (13) is reduced in pressure, while the liquid side space (12) is at atmospheric pressure. Water is evaporated from the heat transfer medium in the liquid side space (12), and the water vapor passes through the moisture permeable membrane (14) and moves to the gas side space (13). The water vapor in the gas side space (13) is evacuated by the evacuating means (20) so that the pressure of the gas side space (13) is held. On the other hand, the heat transfer medium in the liquid side space (12) is cooled by loosing latent heat of evaporation. Then, cold heat is extracted by taking out the cooled heat transfer medium from the liquid side space (12).

In the second solution, the condenser (15) is provided. This condenser (15) condenses water vapor evacuated from the evaporator (11) by the evacuating means. The condenser (15) is formed of a container-like member (55). The water vapor is supplied from the evacuating means to the gas side space (17) of the container-like member (55) as the condenser (15). The water vapor moves to the liquid side space (16) through the moisture permeable membrane (18) and condenses through the contact with the heat transfer medium with which is filled the liquid side space (16).

In the third solution, the inside of the evaporator (11) is held in a reduced-pressure condition, and water evaporates from the heat transfer medium stored in the evaporator (11). The condenser (15) is formed of a container-like member (55). The water vapor in the evaporator (11) is sent into the gas side space (17) of the container-like member (55) as the condenser (15) by the evacuating means (20). The water vapor in the gas side space (17) moves to the liquid side space (16) through the moisture permeable membrane (18) and condenses through the contact with the heat transfer medium with which is filled the liquid side space (16).

In the fourth solution, a heat pumping operation is performed. Specifically, when water vapor condenses in the condenser (15), water vapor releases heat of condensation. The heat of condensation released from the water vapor is used to heat the heat transfer medium.

In the fifth solution, the evacuating means (20) is composed of a compressor (21). Water vapor in the evaporator (11) is sucked into the compressor (21) so that the inside of the evaporator (11) is held at a predetermined pressure. The compressor (21) compresses the water vapor sucked by itself and then pumps it into the condenser (15).

In the sixth solution, the evacuating means (20) is provided with an absorbing medium. The evacuating means (20) sucks water vapor from the evaporator (11) by causing the absorbing medium to absorb the water vapor. Thus, the inside of the evaporator (11) is held at a predetermined pressure. Further, the evacuating means sends into the condenser (15) the water vapor released from the absorbing medium. In other words, the water vapor evacuated from the evaporator (11) is sent into the condenser (15) via the absorbing medium.

In the seventh solution, the evacuating means (20) is composed of water vapor generating means (115) and an ejector (110). Relatively high-pressure water vapor, which has been generated by the water vapor generating means (115), is sent into the ejector (110) and ejected therefrom at a high speed. Then, a high-speed water vapor jet produced by the ejector (110) causes the water vapor in the evaporator (11) to be sucked into the ejector (110) and evacuated therefrom.

In the eighth solution, the inner space of the container-like member (55) is divided into liquid side spaces (12, 16) and gas side spaces (13, 17) by the multiplicity of moisture permeable tubes (60). The inside of each moisture permeable tube (60) is formed into the liquid side space (12, 16), while the outside thereof is formed into the gas side space (13, 17). Therefore, the surfaces of all of the multiplicity of moisture permeable tubes (60) form gas-liquid interfaces from which water of the heat transfer medium is evaporated.

In the ninth solution, one surface of the moisture permeable membrane (14, 18) is covered with a porous film (61). For example, if the container-like member (55) is used as the evaporator (11), water vapor provided by evaporation of the heat transfer medium in the liquid side space (12) passes through the moisture permeable membrane (14) and further pores of the porous film (61), and then moves to the gas side space (13).

In this respect, a pressure difference exists between the liquid side space (12, 16) and the gas side space (13, 17) in the container-like member (55). Therefore, the moisture permeable membrane (14, 18) is desired to have a sufficient strength to accommodate the pressure difference. In this solution, however, a two-layer structure is constituted by the moisture permeable membrane (14, 18) and the porous film (61). Therefore, the structure ensures a sufficient strength to accommodate the pressure difference between the liquid side space (12, 16) and the gas side space (13, 17) while permeating water vapor well.

In the tenth solution, the moisture permeable membrane (14, 18) is formed to have water repellency. In other words, water is repelled on the surface of the moisture permeable membrane (14, 18). Accordingly, even when the heat transfer medium is cooled by evaporation to generate a frozen product, such a frozen product never sticks to the surface of the moisture permeable membrane (14).

In the eleventh solution, evaporation of water in the evaporator (11) cools the heat transfer medium to produce a frozen product.

In the twelfth solution, cold heat is accumulated by storing in the heat storage tank (67) the frozen product produced by the evaporator (11).

In the thirteenth solution, cold heat is accumulated by storing in the heat storage tank (67) the heat transfer medium cooled by the evaporator (11). During the heat utilization operation, the system generates cold heat by evaporating water in the evaporator (11) and concurrently supplies to the condenser (15) the heat transfer medium stored in the heat storage tank (67) through the heat storage operation. In other words, cold heat stored in the heat storage tank (67) is used to condense water vapor in the condenser (15).

In the fourteenth solution, cold heat is accumulated by storing in the heat storage tank (67) the heat transfer medium cooled by the evaporator (11). During the heat utilization operation, the system supplies to the evaporator (11) the heat transfer medium stored in the heat storage tank (67) through the heat storage operation, and further cools it to produce a frozen product slurry. The produced frozen product slurry is supplied to the heat utilization means (32) so as to be used for the purpose of cooling an object to be cooled or other purposes. Specifically, if the frozen product slurry is allowed to stand stored in the heat storage tank (67), it will not in due course be circulated in the form of a slurry due to cohesion of its particles. In this solution, however, the frozen product is produced during the heat utilization operation and can be therefore utilized in the form of a slurry capable of circulation.

In the fifteenth solution, the first and second cooling operations are made. The first cooling operation is performed at large cooling loads and is that of supplying to the heat utilization side heat exchanger (32) a relatively low-temperature heat transfer medium cooled by the evaporator (11) and thereby cooling an object to be cooled. On the other hand, the second cooling operation is performed at small cooling loads and is that of supplying to the heat utilization side heat exchanger (32) a heat transfer medium cooled by only the cooling tower (90) and thereby cooling an object to be cooled.

Effects

In the first solution, the evaporator is formed of a container-like member (55). Accordingly, in the evaporator (11), only the gas side space (13) is reduced in pressure while the liquid side space (12) is at atmospheric pressure. Therefore, a cooled heat transfer medium can easily be extracted from the liquid side space (12). Specifically, it is necessary for the prior art to raise the pressure of the heat transfer medium in reduced-pressure condition and then extract it, whereas it is necessary for this solution only to extract the heat transfer medium in atmospheric pressure condition from the evaporator (11). Therefore, there is no need for the mechanism that raises the pressure of the heat transfer medium for the purpose of extracting cold heat, which simplifies the system. Further, even when a pump or the like is used to give the heat transfer medium a conveying force, no special consideration is needed of cavitation, unlike the prior art.

Further, the evaporator (11) is formed of a container-like member (55) and the moisture permeable membrane (14) forms a gas-liquid interface in the evaporator (11). Therefore, the form of the gas-liquid interface can be arbitrarily set by changing the shape of the moisture permeable membrane (14). For example, if the moisture permeable membrane (14) is defined in a cornice shape or the like, the area of the gas-liquid interface can be increased. Accordingly, the area of the gas-liquid interface can be increased while the evaporator (11) is kept in a small size. This enhances evaporation of water from the heat transfer medium.

In the second to fourth solutions, the condenser (15) is formed of a container-like member (55). Accordingly, water vapor in the gas side space (17) can move to the liquid side space (16) through the moisture permeable membrane (18), and the water vapor can condense through the contact with the heat transfer medium in the liquid side space (16). Therefore, as compared with the case where heat exchange is made through indirect contact between water and water vapor as in the prior art, heat loss due to heat exchange can be reduced thereby providing enhanced efficiency. Particularly in the fourth solution, a heat pumping operation is provided using heat of condensation.

In the eighth solution, the moisture permeable tubes (60) define liquid side spaces (12, 16) and gas side spaces (13, 17). Therefore, if the container-like member (55) is used as the evaporator (11), the area of the gas-liquid interface in the evaporator (11) can largely be increased without upsizing the evaporator (11). As a result, evaporation of water from the heat transfer medium can be well enhanced, and a sufficient cooling capacity can be attained while the evaporator (11) is kept in a small size. Further, also when the container-like member (55) is used as the condenser (15), condensation can be enhanced thereby providing a downsized condenser (15).

According to the ninth solution, the two-layer structure made up of the moisture permeable membrane (14, 18) and the porous film (61) ensures strength. Therefore, any trouble from breakage of the moisture permeable membrane (14, 18) can be obviated, which enhances reliability.

According to the tenth solution, a container-like member (55) well adapted especially for an evaporator (11) for producing a frozen product can be formed by using a repellent moisture permeable membrane (14, 18). Specifically, if a frozen product sticks to the moisture permeable membrane (14), this blocks permeation of water vapor. In this solution, however, sticking of the frozen product to the moisture permeable membrane (14) can be prevented, which provides sufficiently ensured evaporation of water from the heat transfer medium.

According to the eleventh to fifteenth solutions, various operations such as production of a frozen product and heat storage can be effected. Particularly in the fifteenth solution, even if the cooling load varies, an optimal operation according to the cooling load can be performed by separately using the cooling operation via the evaporator (11) and the cooling operation via the cooling tower (90).

BEST MODE FOR CARRYING OUT THE INVENTION

Hereinafter, embodiments of the present invention will be described in detail with reference to the drawings.

<<First Embodiment>>

Figure 1:
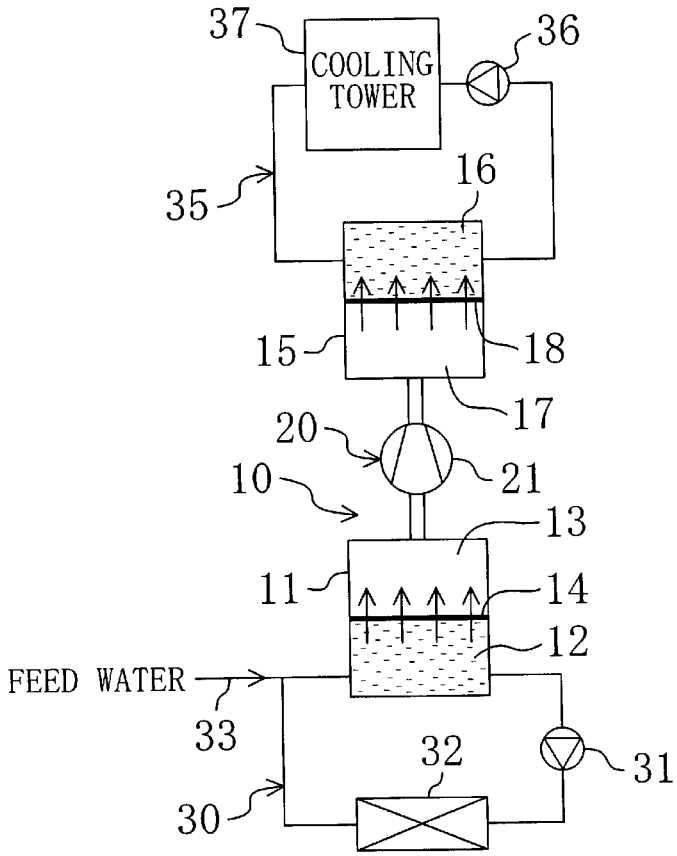
FIG. 1 is a schematic diagram of the structure of an air conditioner according to Embodiment 1.

As shown in FIG. 1, the present embodiment is intended for an air conditioner that effects cooling with the use of a cooling water generated by a refrigeration system (10).

The refrigeration system (10) includes an evaporator (11), a condenser (15), and a compressor (21) which is an evacuating means (20). The evaporator (11) and the condenser (15) are each formed of a container-like member (55). The container-like member (55) includes a main part (56) in the form of a hollow container, and the inside of the main part (56) is divided into a liquid side space (12, 16) and a gas side space (13, 17) by a moisture permeable membrane (14, 18). The details of the container-like member (55) will described later.

The suction side of the compressor (21) is connected to the gas side space (13) of the evaporator (11). The discharge side of the compressor (21) is connected to the gas side space (17) of the condenser (15). The compressor (21) is arranged to suck water vapor from the gas side space (13) of the evaporator (11), compress the water vapor and pump it into the gas side space (17) of the condenser (15).

The liquid side space (12) of the evaporator (11) is filled with a heat transfer water as a heat transfer medium. Accordingly, the surface of the moisture permeable membrane (14) presented to the liquid side space (12) is in contact with the heat transfer water. In the evaporator (11), the gas side space (13) is held at a reduced pressure (for example, about 4 mmHg) while the liquid side space (12) is placed into an atmospheric pressure condition. The evaporator (11) is arranged to evaporate part of the heat transfer water in the liquid side space (12) and on the other hand cool the remaining heat transfer water, and then move the generated water vapor to the gas side space (13). Namely, the water vapor passes through the moisture permeable membrane (14) and thereby moves to the gas side space (13).

The liquid side space (12) of the evaporator (11) is connected with a heat utilization side circuit (30). The heat utilization side circuit (30) includes a circulating pump (31) and a heat utilization side heat exchanger (32) and is arranged to circulate the heat transfer water therethrough. The circulating pump (31) is connected at its suction side to the liquid side space (12) of the evaporator (11), and connected at its discharge side to one end of the heat utilization side heat exchanger (32). The other end of the heat utilization side heat exchanger (32) is connected to the liquid side space (12) of the evaporator (11). Thus, the heat utilization side circuit (30) pumps, into the heat utilization side heat exchanger (32), the heat transfer water cooled in the liquid side space (12) of the evaporator (11), and heat exchanges the heat transfer water with a room air to cool the room air. In addition, a feed water pipe (33) is connected between the heat utilization side circuit (30) and the evaporator (11). The feed water pipe (33) supplies a city water to the heat utilization side circuit (30) to compensate for an evaporated portion of water in the evaporator (11).

The liquid side space (16) of the condenser (15) is filled with a cooling water as a heat transfer medium. Accordingly, the surface of the moisture permeable membrane (18) presented to the liquid side space (16) is in contact with the cooling water. In the condenser (15), the gas side space (17) is held at a reduced pressure (for example, about 20 mmHg) while the liquid side space (16) is placed into an atmospheric pressure condition. The gas space (17) of the condenser (15) is place under higher pressure conditions that the gas side space (13) of the evaporator (11). The condenser (15) is arranged to move, to the liquid side space (16), the water vapor pumped into the gas side space (17) by the compressor (21), and bring the water vapor into contact with the cooling water in the liquid side space (16) to condense it. Namely, the water vapor passed through the moisture permeable membrane (18) and thereby moves to the liquid side space (16).

The liquid side space (16) of the condenser (15) is connected with a heat exhaust side circuit (35). The heat exhaust side circuit (35) includes a circulating pump (36) and a cooling tower (37) and is arranged to circulate the cooling water therethrough. The circulating pump (36) is connected at its suction side to the liquid side space (16) of the condenser (15), and connected at its discharge side to one of the cooling tower (37). The other end of the cooling tower (37) is connected to the liquid side space (16) of the condenser (15). Thus, the heat exhaust side circuit (35) sends, into the cooling tower (37), the cooling water heated by condensation of water vapor in the liquid side space (16) of the condenser (15), cools the cooling water in the cooling tower (37), and sends it into the liquid side space (16) again. The cooling tower (37) may be of commonly used type. Consequently, in the cooling tower (37), part of the cooling water evaporates, the rest thereof is cooled, and the evaporated part of the water is released to the open air.

Figure 2:
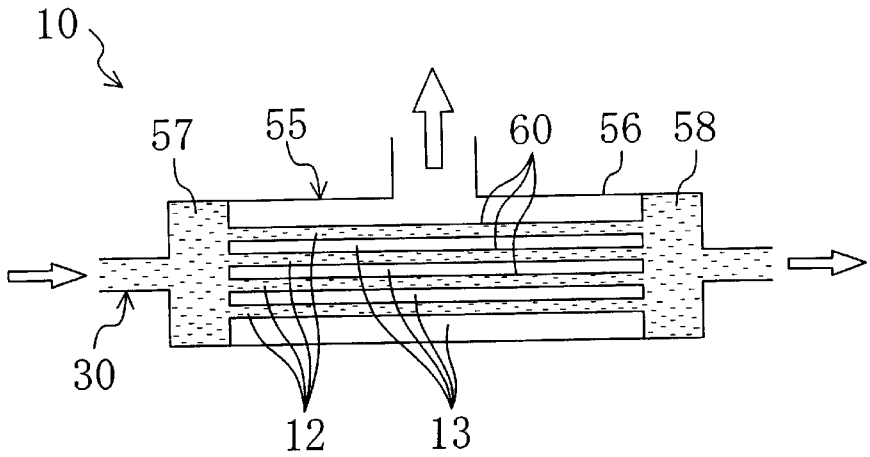
FIG. 2 is a schematic diagram of the structure of a container-like member (evaporator) according to Embodiment 1.

Next, the structure of the container-like member (55) will be described with reference to FIG. 2. It is to be noted that FIG. 2 shows the container-like member (55) as the evaporator (11).

The main part (56) of the container-like member (55) is configured in the shape of an elongated hollow cylinder. The main part (56) is provided at its one end with an inlet header (57) and at the other end with an outlet header (58). The main part (56) contains a multiplicity of moisture permeable tubes (60) each constituted by the moisture permeable membrane (14, 18). Each moisture permeable tube (60) is open at its one end to the inlet header (57), open at the other end to the outlet header (58), and disposed in a position in which its axial direction matches the longitudinal direction of the main part (56). The inside of the main part (56) is divided into liquid side spaces (12, 16) and a gas side space (13, 17) by the moisture permeable tubes (60). In other words, in the main part (56), the inside of the moisture permeable tube (60) constitutes the liquid side space (12, 16) while the outside thereof constitutes the gas side space (13, 17).

If the container-like member (55) is used as the evaporator (11), the inlet header (57) and the outlet header (58) are connected to the heat utilization side circuit (30). Specifically, the outlet header (58) is connected to the suction side of the circulating pump (31), while the inlet header (57) is connected to the outlet end of the heat utilization side heat exchanger (32). On the other hand, if the container-like member (55) is used as the condenser (15), the inlet header (57) and the outlet header (58) are connected to the heat exhaust side circuit (35). Specifically, the outlet header (58) is connected to the suction side of the circulating pump (36), while the inlet header (57) is connected to the outlet end of the cooling tower (37).

Figure 3:
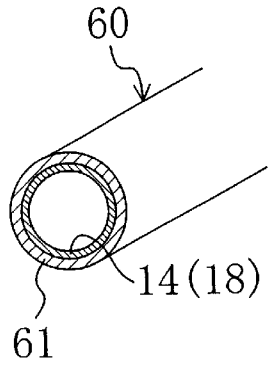
FIG. 3 is a schematic perspective view of a moisture permeable tube according to Embodiment 1.

Further, as shown in FIG. 3, the moisture permeable tube (60) has a two-layer structure of the moisture permeable membrane (14, 18) and a porous film (61). In other words, the porous film (61) externally covers the moisture permeable membrane (14, 18) configured in a tubular form. The moisture permeable membrane (14, 18) is formed into that of so-called gas molecule diffusion type which permeates water vapor through the diffusion of gas molecules into the membrane. As its specific example, the moisture permeable membrane (14, 18) is formed of fluororesin or polyimide resin. The porous film (61) is formed with a large number of pores which water vapor can permeate. The porous film (61) reinforces the moisture permeable membrane (14, 18) without impairing permeability thereby enhancing the pressure resistance of the moisture permeable tube (60).

Behavior in Operation

In the liquid side space (12) of the evaporator (11), part of the heat transfer water evaporates to take latent heat of evaporation from the remaining heat transfer water, so that the remaining heat transfer water is cooled. The heat transfer water thus cooled is pumped into the heat utilization side heat exchanger (32) by the circulating pump (31) of the heat utilization side circuit (30). The heat utilization side heat exchanger (32) heat exchanges the heat transfer water pumped thereinto with the room air to cool the room air. Thereafter, the heat transfer water is sent from the heat utilization side heat exchanger (32) to the liquid side space (12) and is cooled therein again. The heat transfer water repeats this circulation. During the time, a city water is supplied to the heat utilization side circuit (30) through the feed water pipe (33) to compensate for a reduction of the amount of heat transfer water due to its evaporation in the evaporator (11).

The water vapor, which has been generated by evaporation of water in the liquid side space (12) of the evaporator (11), passes through the moisture permeable membrane (14) of the moisture permeable tube (60) and moves to the gas side space (13). The water vapor which has moved to the gas side space (13) is sucked by the compressor (21) and is thereby discharged from the gas side space (13). Accordingly, the pressure of the gas side space (13) is held at a predetermined value. The water vapor sucked into the compressor (21) is compressed and then sent into the condenser (15).

The water vapor is pumped into the gas side space (17) of the condenser (15) by the compressor (21). The water vapor in the gas side space (17) passes through the moisture permeable membrane (18) of the moisture permeable tube (60) and moves to the liquid side space (16). In the liquid side space (16), the water vapor which has permeated the moisture permeable membrane (18) condenses through the contact with the cooling water. The cooling water in the liquid side space (16) absorbs heat of condensation of the water vapor and thereby raises its temperature. The cooling water increased in temperature is sent to the cooling tower (37) by the circulating pump (36) of the heat exhaust side circuit (35), cooled in the cooling tower (37), and then supplied to the liquid side space (16) again. The cooling water repeats this circulation.

Effects of Embodiment 1

In Embodiment 1, the evaporator (11) is formed of a container-like member (55). Accordingly, in the evaporator (11), only the gas side space (13) is reduced in pressure while the liquid side space (12) remains at atmospheric pressure. Therefore, the cooled heat transfer water can easily be extracted from the liquid side space (12). Specifically, it is necessary for the prior art to first raise the pressure of the heat transfer water in reduced-pressure condition and then extract it, whereas it is necessary for this solution only to extract the heat transfer water in atmospheric pressure condition from the liquid side space (12) of the evaporator (11). Accordingly, the circulating pump (31) of the heat utilization side circuit (30) need only suck the heat transfer water from the liquid side space (12) in atmospheric pressure condition. This avoids the occurrence of cavitation in the circulating pump (31) thereby providing enhanced reliability.

Further, the liquid side space (12, 16) and the gas side space (13, 17) of the container-like member (55) are separated by the moisture permeable tube (60), and the evaporator (11) and the condenser (15) are each formed of the container-like member (55). Accordingly, the gas-liquid interfaces in the evaporator (11) and the condenser (15) can be extended, which enhances evaporation of the heat transfer water in the evaporator (11) and condensation of water vapor into cooling water in the condenser (15). Therefore, the evaporator (11) and the condenser (15) can ensure their sufficient performance while being kept in small size.

Furthermore, since the moisture permeable tube (60) has a two-layer structure of the moisture permeable membrane (14, 18) and the porous film (61), it can ensure strength against pressure. Therefore, any trouble from breakage of the moisture permeable tube (60) can be obviated, which provides enhanced reliability.

Modified Form of Embodiment 1

In Embodiment 1 described above, the condenser (15) is connected to the heat exhaust side circuit (35), and heat of condensation of water vapor is processed with the cooling water circulating through the heat exhaust side circuit (35). Instead of this, heat of condensation of water vapor may be processed using a river water or sea water. Specifically, a river water or sea water is taken in, introduced into the liquid side space (16) of the condenser (15) to absorb heat of condensation, and then returned to the river or the sea. In this case, not a metallic heat transfer pipe but a resin-made moisture permeable membrane is used for the condenser (15). Therefore, the system can use the river water or the sea water while avoiding a problem of corrosion of the heat transfer pipe and the like.

<<Second Embodiment>>

Figure 4:
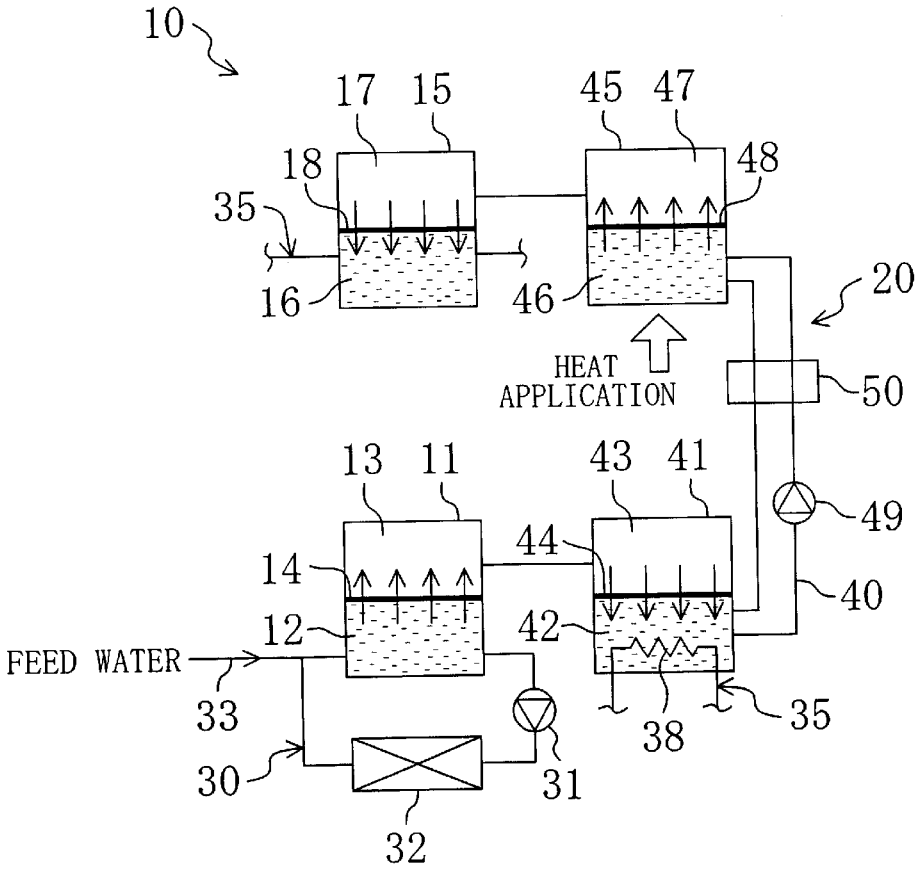
FIG. 4 is a schematic diagram of the structure of an air conditioner according to Embodiment 2.

In Embodiment 2 of the present invention, the construction of the evacuating means (20) in Embodiment 1 is changed. Hereinafter, different points from Embodiment 1 will be described with reference to FIG. 4. It is to be noted that in FIG. 4, only part of the heat exhaust side circuit (35) is shown.

The evacuating means (20) of Embodiment 2 is constituted by a heat absorption side circuit (40). The heat absorption side circuit (40) is constructed by connecting an absorber (41), a solution pump (49) and a regenerator (45) in this order through piping. In the heat absorption side circuit (40), an absorbing solution is circulated by the solution pump (49). Examples of the absorbing solution include a lithium bromide water solution and a lithium chloride water solution. Further, the heat absorption side circuit (40) is provided with a solution heat exchanger (50) which heat exchanges the absorbing solution being sent from the absorber (41) to the regenerator (45) with the absorbing solution being sent from the regenerator (45) to the absorber (41). In addition, the absorber (41) and the regenerator (45) are, like the evaporator (11) and the condenser (15), each formed of a container-like member (55).

A liquid side space (42) of the absorber (41) is connected to the heat absorption side circuit (40) and filled with the absorbing solution. Further, the liquid side space (42) of the absorber (41) is provided with a cooling heat exchanger (38). The cooling heat exchanger (38) is connected to the heat exhaust side circuit (35), and cools the absorbing solution in the liquid side space (42) by means of the cooling water in the heat exhaust side circuit (35). A gas side space (43) of the absorber (41) is connected to the gas side space (13) of the evaporator (11). Water vapor in the gas side space (13) of the evaporator (11) is sent into the gas side space (43) of the absorber (41), passes through the moisture permeable membrane (44) of the absorber (41), and is then absorbed in the absorbing solution in the liquid side space (42).

A liquid side space (46) of the regenerator (45) is connected to the heat absorption side circuit (40) and filled with the absorbing solution. The regenerator (45) is arranged to apply heat to the absorbing solution in the liquid side space (46) to regenerate the absorbing solution. A gas side space (47) of the regenerator (45) is connected to the gas side space (17) of the condenser (15). In the regenerator (45), the absorbing solution in the liquid side space (46) is heated, and water vapor generated by evaporation of the absorbing solution passes through the moisture permeable membrane (48) and then moves to the gas side space (47). The water vapor in the gas side space (47) is sent into the gas side space (17) of the condenser (15).

Behavior in Operation

Hereinafter, the behavior of the heat absorption side circuit (40) will be described. Other behaviors are the same as in Embodiment 1.

Water vapor in the gas side space (13) of the evaporator (11) is sucked into the gas side space (43) of the absorber (41). Thus, the gas side space (13) of the evaporator (11) is held at a predetermined pressure. The water vapor pumped into the gas side space (43) of the absorber (41) passes through the moisture permeable membrane (44) and is then absorbed in the absorbing solution in the liquid side space (42). The absorbing solution, which has been reduced in concentration by absorption of water vapor, is sent to the liquid side space (46) of the regenerator (45) by the solution pump (49). During the time, the absorbing solution is preheated through the heat exchange in the solution heat exchanger (50) with the absorbing solution being sent from the regenerator (45), and then introduced into the regenerator (45).

In the liquid side space (46) of the regenerator (45), heat is applied to the absorbing solution. The heated absorbing solution evaporates its water content so as to be regenerated. The absorbing solution increased in concentration by regeneration is sent back to the liquid side space (42) of the absorber (41). On the other hand, the water vapor provided by evaporation of the absorbing solution passes through the moisture permeable membrane (48) and moves to the gas side space (47). The water vapor in the gas side space (47) of the regenerator (45) is then sent into the gas side space (17) of the condenser (15). To sum up, the water vapor in the gas side space (13) of the evaporator (11) is sent, by means of the absorbing solution, from the absorber (41) to the regenerator (45) and then from the regenerator (45) to the gas side space (17) of the condenser (15).

<<Third Embodiment>>

Figure 5:
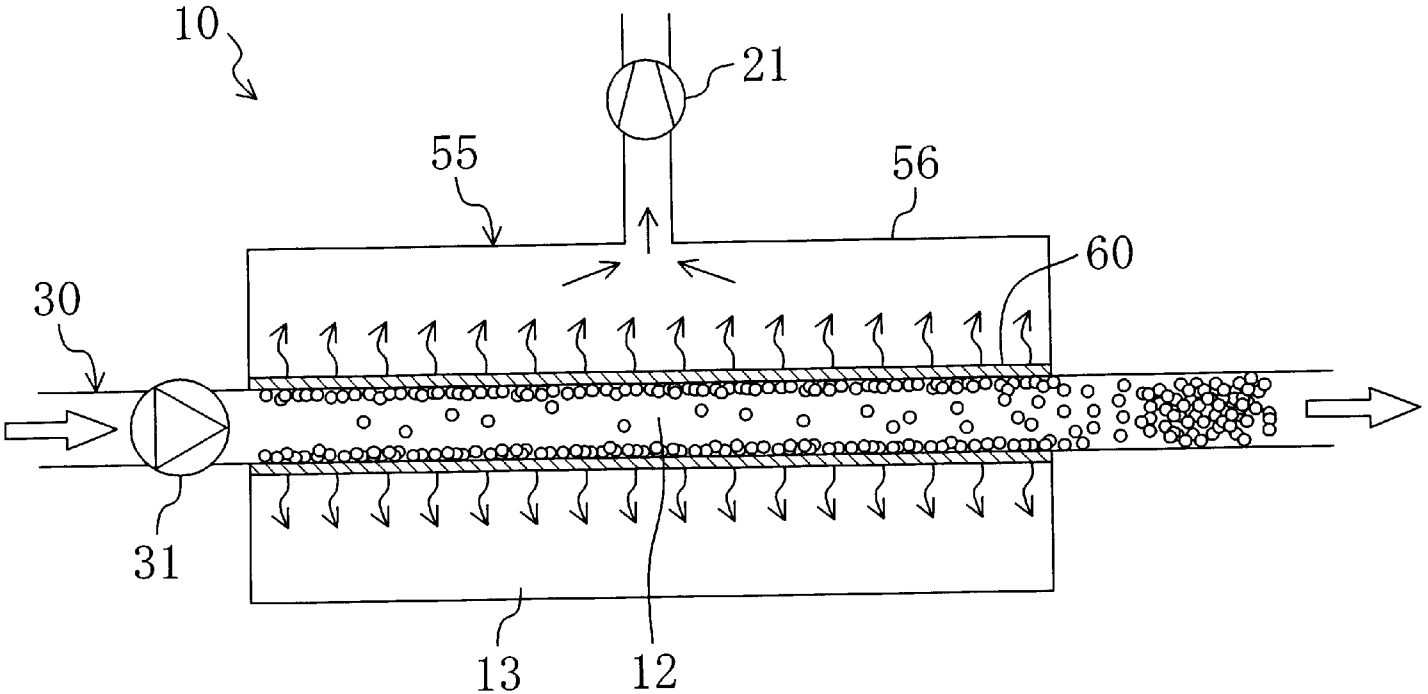
FIG. 5 is an enlarged diagram of the essential parts of a refrigeration system according to Embodiment 3.

Embodiment 3 of the present invention is arranged to produce ice in the evaporator (11) of Embodiment 1. Hereinafter, different points from Embodiment 1 will be described with reference to FIG. 5. In FIG. 5, only a single moisture permeable tube (60) is schematically illustrated and the inlet header (57) and the outlet header (58) are omitted.

In the container-like member (55) used for the evaporator (11) of this embodiment, its moisture permeable membrane is made of repellent material. Therefore, a heat transfer water is repelled on the inner surface of the moisture permeable tube (60) so that ice particles are produced. Accordingly, ice is not stuck to the inner surface of the moisture permeable tube (60) and the transfer of water vapor to the outside of the moisture permeable tube (60) is not interfered with. Further, the evaporator (11) is arranged to evaporate about 4% of the circulation amount of heat transfer water. In this respect, because of the difference between heat of evaporation and heat of solidification, evaporation of 1 kg water would result in production of about 7.5 kg ice. Accordingly, in the evaporator (11), an ice-water slurry containing about 30% ice is produced.

The ice-water slurry produced in the evaporator (11) is sent to the heat utilization side heat exchanger (32) of the heat utilization side circuit (30), and used to cool the room air. It is to be noted that in the heat utilization side circuit (30) of this embodiment, the circulating pump (31) is provided upstream from the evaporator (11). Further, according to this embodiment, cold heat can be conveyed not by cold water but by the ice-water slurry. This increases the amount of cold heat conveyed without increasing the amount of heat transfer water circulated.

Modified Form of Embodiment 3

In Embodiment 3, the refrigeration system (10) is used to construct the air conditioner which performs cooling in a manner that cold heat is conveyed by the ice-water slurry produced therein. The refrigeration system (10), however, may be used to construct an ice making machine to produce ice flakes for use in chilling foods. In this case, the evaporator (11) is continuously supplied with water from the outside, and ice particles are separated from the produced ice-water slurry so as to be used as ice flakes.

<<Fourth Embodiment>>

Figure 6:
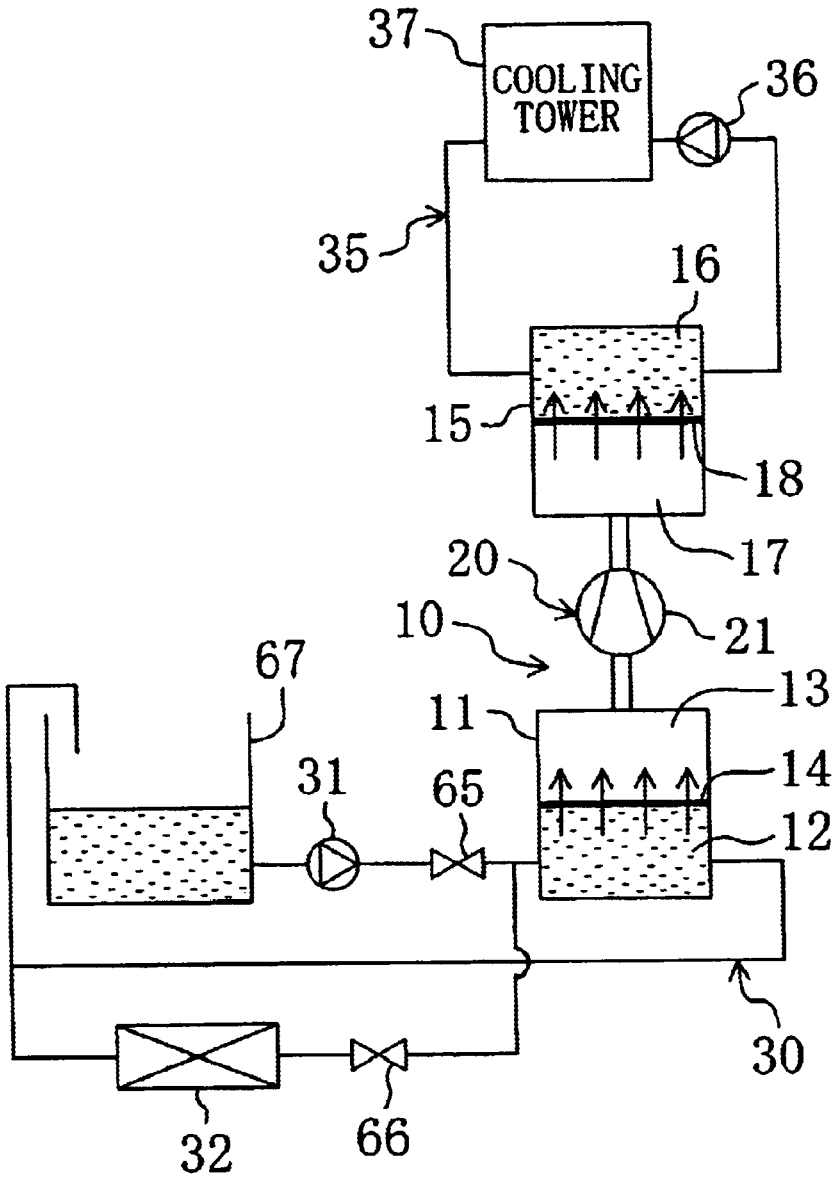
FIG. 6 is a schematic diagram of the structure of an air conditioner according to Embodiment 4.

Embodiment 4 of the present invention is arranged to perform ice storage in Embodiment 1. Hereinafter, different points from Embodiment 1 will be described with reference to FIG. 6.

The evaporator (11) in this embodiment is constructed like Embodiment 3. Specifically, in the evaporator (11), a moisture permeable membrane (14) is made of repellent material. Further, the evaporator (11) is arranged to produce ice slurry.

Next, the construction of the heat utilization side circuit (30) will be described. The heat utilization side circuit (30) of this embodiment is provided with a heat storage tank (67). The heat storage tank (67) is connected to the liquid side space (12) of the evaporator (11) so that a heat transfer water circulates between them. Further, the circulating pump (31) for sucking the heat transfer water from the heat storage tank (67), and a first shut-off valve (65) are sequentially disposed between the heat storage tank (67) and the evaporator (11). The inlet end of the heat utilization side heat exchanger (32) is connected between the circulating pump (31) and the first shut-off valve (65) through a second shut-off valve (66). The outlet end of the heat utilization side heat exchanger (32) is connected to the heat storage tank (67).

In the nighttime, the system performs a heat storage operation. During the heat storage operation, the first shut-off valve (65) is opened while the second shut-off valve (66) is closed. In these conditions, the circulating pump (31) is operated to circulate the heat transfer water between the heat storage tank (67) and the evaporator (11). Then, a water-ice slurry produced by the evaporator (11) is pumped to the heat storage tank (67), and ice is stored in the heat storage tank (67) for thermal storage.

On the other hand, in the daytime, the system performs a heat utilization operation. During the heat utilization operation, the first shut-off valve (65) is closed while the second shut-off valve (66) is opened. In these conditions, the circulating pump (31) is operated to circulate the heat transfer water between the heat storage tank (67) and the heat utilization side heat exchanger (32). Then, cold heat accumulated through the heat storage operation is used to cool the room air for cooling.

<<Fifth Embodiment>>

Embodiment 5 of the present invention is arranged so that the system of Embodiment 1 is provided with the heat storage tank (67) to effect cold heat storage. In this embodiment, the system performs a heat storage operation of storing in the heat storage tank (67) the heat transfer water cooled by the evaporator (11), a first heat utilization operation of sending cold heat of the heat transfer water stored in the heat storage tank (67) to the condenser (15) and using it for cooling in the condenser (15), and a second heat utilization operation of sending the heat transfer water in the heat storage tank (67) to the evaporator (11) and further cooling it to produce an ice slurry.

Figure 7:
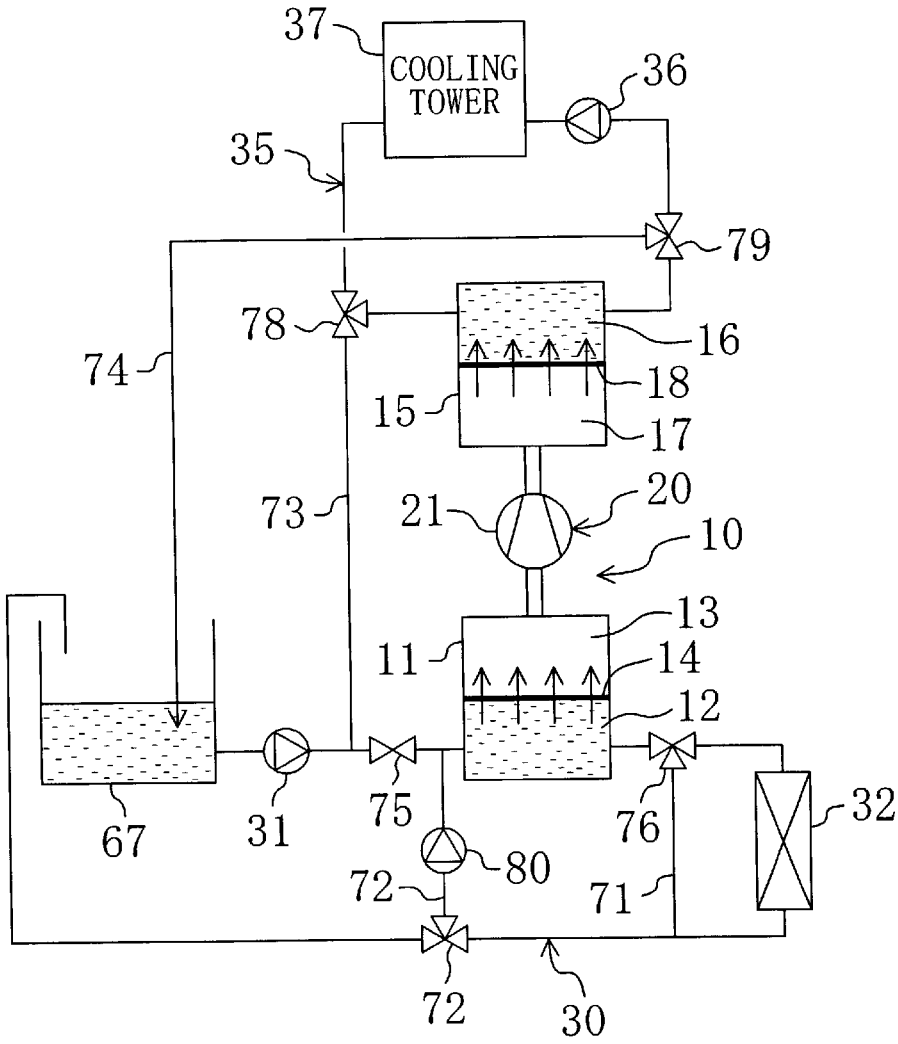
FIG. 7 is a schematic diagram of the structure of an air conditioner according to Embodiment 5.

As shown in FIG. 7, the heat utilization side circuit (30) of this embodiment is constructed so that the heat storage tank (67), the circulating pump (31), a shut-off valve (75), the evaporator (11) and the heat utilization side heat exchanger (32) are connected in this order. The heat utilization side circuit (30) is provided with a first bypass pipe (71), a second bypass pipe (72), a feed pipe (73) and a return pipe (74). It is to be noted that the heat utilization side heat exchanger (32) of this embodiment is formed into a heat utilization means.

The first bypass pipe (71) is arranged to bypass the heat utilization side heat exchanger (32). Specifically, one end of the first bypass pipe (71) is connected to the upstream side of the heat utilization side heat exchanger (32) via a first three-way valve (76), and the other end thereof is connected to the downstream side of the heat utilization side heat exchanger (32). The first three-way valve (76) switches between a position to allow the heat transfer water from the evaporator (11) to flow into the heat utilization side heat exchanger (32) and a position to allow the heat transfer water to flow into the first bypass pipe (71).

The second bypass pipe (72) is arranged to bypass the heat storage tank (67), the circulating pump (31) and the shut-off valve (75). Specifically, one end of the second bypass pipe (72) is connected through a second three-way valve (77) to a portion of the circuit which is located between the heat utilization side heat exchanger (32) and the heat storage tank (67) and downstream from a connecting point of the bypass pipe. The other end of the second bypass pipe (72) is connected between the shut-off valve (75) and the evaporator (11). Further, the second bypass pipe (72) is provided with a bypassing pump (80) for pumping the heat transfer water from one end to the other end of the second bypass pipe (72). The second three-way valve (77) switches between a position to allow the heat transfer water from the heat utilization side heat exchanger (32) to flow into the heat storage tank (67) and a position to allow the heat transfer water to flow into the evaporator (11).

The feed pipe (73) is connected at one end thereof between the circulating pump (31) and the shut-off valve (75). The other end of the feed pipe (73) is connected through a third three-way valve (78) between the cooling tower (37) and the condenser (15) in the heat exhaust side circuit (35). The third three-way valve (78) switches between a position to allow the heat transfer water from the feed pipe (73) to serve as a cooling water and flow into the condenser (15) and a position to allow the cooling water from the cooling tower (37) to flow into the condenser (15).

One end of the return pipe (74) is connected through a fourth three-way valve (79) between the condenser (15) and the circulating pump (36) in the heat exhaust side circuit (35). The other end of the return pipe (74) is connected to the heat storage tank (67). The fourth three-way valve (79) switches between a position to allow the cooling water from the condenser (15) to flow into the cooling tower (37) and a position to return the cooling water to the return pipe (74).

Further, the liquid side space (12) of the evaporator (11) is connected to the feed water pipe (33). The feed water pipe (33) supplies a city water to the liquid side space (12) of the evaporator (11).

Behavior in Operation

In the nighttime, the system performs a heat storage operation. During the heat storage operation, the shut-off valve (75) is opened, the first three-way valve (76) is switched to the position to communicate with the first bypass pipe (71), and the second three-way valve (77) is switched to the position to communicate with the heat storage tank (67). Also, the third three-way valve (78) is switched to the position to communicate with the cooling tower (37) and the fourth three-way valve (79) is switched to the position to communicate with the circulating pump (36). Under these conditions, in the heat utilization side circuit (30), the circulating pump (31) is operated to circulate the heat transfer water between the heat storage tank (67) and the evaporator (11). Then, the heat transfer water cooled by the evaporator (11) is stored in the heat storage tank (67) so that cold heat is accumulated in the heat storage tank (67). On the other hand, in the heat exhaust side circuit (35), the circulating pump (36) is operated to circulate the cooling water between the condenser (15) and the cooling tower (37).

In the daytime, the first and second heat utilization operations are selectively performed. Both the heat utilization operations are adequately selected to accord with the operating conditions such as air-conditioning load.

During the first heat utilization operation, the shut-off valve (75) is closed, the first three-way valve (76) is switched to the position to communicate with the heat utilization side heat exchanger (32), and the second three-way valve (77) is switched to the position to communicate with the second bypass passage. Also, the third three-way valve (78) is switched to the position to communicate with the feed pipe (73) and the fourth three-way valve (79) is switched to the position to communicate with the return pipe (74). Under these conditions, in the heat utilization side circuit (30), the bypassing pump (80) is operated to circulate the heat transfer water between the evaporator (11) and the heat utilization side heat exchanger (32). Also, in the heat utilization side circuit (30), the circulating pump (31) is operated to circulate the heat transfer water between the heat storage tank (67) and the condenser (15). To sum up, low-temperature heat transfer water accumulated in the heat storage tank (67) through the heat storage operation is supplied to the condenser (15) to process heat of condensation. Since the low-temperature heat transfer water is supplied to the condenser (15), the extent of pressure raised in the compressor (21) can be decreased and therefore the input to the compressor (21) can be reduced.

During the second heat utilization operation, the shut-off valve (75) is opened, the first three-way valve (76) is switched to the position to communicate with the heat utilization side heat exchanger (32), and the second three-way valve (77) is switched to the position to communicate with the heat storage tank (67). Also, the third three-way valve (78) is switched to the position to communicate with the cooling tower (37) and the fourth three-way valve (79) is switched to the position to communicate with the circulating pump (36). Under these conditions, in the heat utilization side circuit (30), the circulating pump (31) is operated to supply the low-temperature heat transfer water in the heat storage tank (67) to the evaporator (11), the heat transfer water is thereby further cooled to produce a water-ice slurry and the produced water-ice slurry is sent to the heat utilization side heat exchanger (32). The heat transfer water from the heat utilization side heat exchanger (32) is supplied to the heat storage tank (67). In the heat exhaust side circuit (35), the circulating pump (36) is operated to circulate the cooling water between the cooling tower (37) and the condenser (15) and thereby process heat of condensation.

Modified Form of Embodiment 5

In Embodiment 5, the heat utilization means is constituted by the heat utilization side heat exchanger (32), and an ice slurry generated by the second heat utilization operation is used to cool the room air in the heat utilization side heat exchanger (32). Alternatively, the heat utilization means may be arranged to separate ice particles from the water-ice slurry and the separated ice may be used as ice flakes to chill foods or for other purposes.

<<Sixth Embodiment>>

Figure 8:
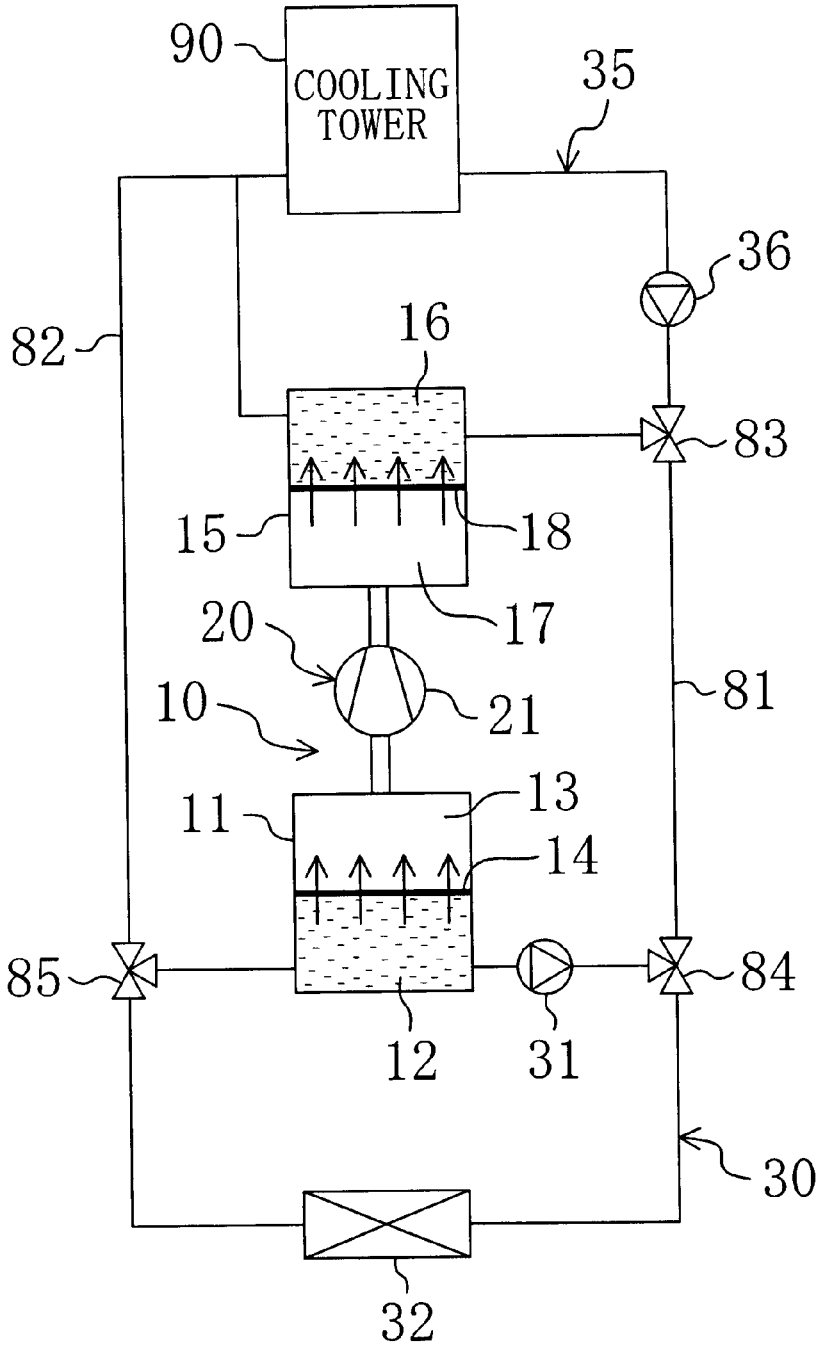
FIG. 8 is a schematic diagram of the structure of an air conditioner according to Embodiment 6.

Embodiment 6 of the present invention is constructed so that a first pipe (81) and a second pipe (82) are additionally provided to Embodiment 1 and a cooling tower (90) is used which is made changes in the structure from that of Embodiment 1. In this embodiment, the system performs, in the summer, a first cooling operation by supplying to the heat utilization side heat exchanger (32) the heat transfer water cooled by the evaporator (11), and performs, in the middle seasons such as spring and autumn, a second cooling operation by supplying to the heat utilization side heat exchanger (32) the heat transfer water cooled by the cooling tower (90). Hereinafter, different points from Embodiment 1 will be described with reference to FIGS. 8 and 9.

In this embodiment, the circulating pump (36) is disposed in the heat exhaust side circuit (35) on the side thereof closer to the outlet of the cooling tower (90). In other words, the circulating pump (36) is disposed downstream from the cooling tower (90) and upstream from the condenser (15).

One end of the first pipe (81) is connected through a heat exhaust side three-way valve (83) between the circulating pump (36) and the condenser (15) in the heat exhaust side circuit (35). The heat exhaust side three-way valve (83) is arranged to switch between a position to communicate with the condenser (15) and a position to communicate with the first pipe (81). The other end of the first pipe (81) is connected through a first heat utilization side three-way valve (84) between the circulating pump (31) and the heat utilization side heat exchanger (32) in the heat utilization side circuit (30). The first heat utilization side three-way valve (84) is arranged to switch between a position to communicate with the evaporator (11) and a position to communicate with the first pipe (81).

One end of the second pipe (82) is connected through a second heat utilization side three-way valve (85) between the heat utilization side heat exchanger (32) and the evaporator (11) in the heat utilization side circuit (30). The second heat utilization side three-way valve (85) is arranged to switch between a position to communicate with the evaporator (11) and a position to communicate with the second pipe (82). The other end of the second pipe (82) is connected to the heat exhaust side circuit (35) between the condenser (15) and the cooling tower (90). In other words, the other end of the second pipe (82) is connected thereto on the cooling tower (90) inlet side.

Figure 9:
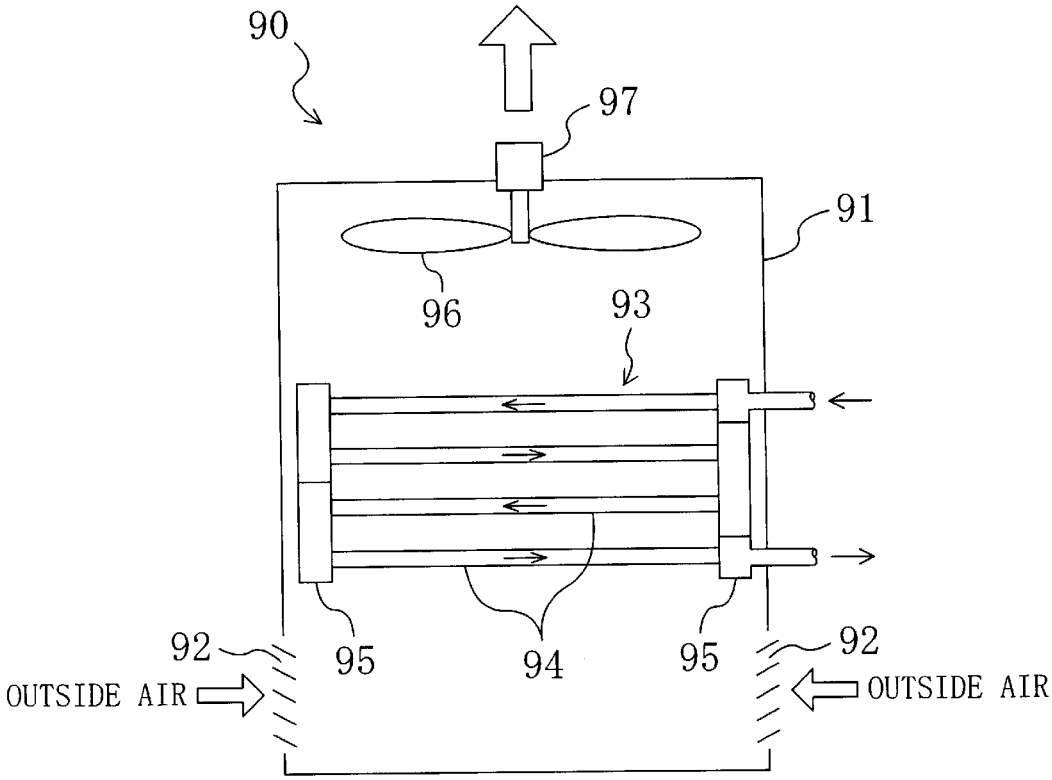
FIG. 9 is a schematic diagram of the structure of a cooling tower according to Embodiment 6.

As shown in FIG. 9, the cooling tower (90) of this embodiment is constructed to contain a cooling section (93) and a fan (96) in a casing (91). The fan (96) is driven in rotation by a fan motor (97) to suck the outside air into the casing (91) through an opening (92) of the casing (91). The cooling section (93) is constructed so that a large number of tubular members (94) each formed of a moisture permeable membrane are provided and a pair of header members (95) are disposed to the corresponding ends of the tubular members (94). The heat transfer water in the heat exhaust side circuit (35) is introduced into each of the tubular members (94) of the cooling section (93), cooled by partially evaporating and thereby releasing heat of evaporation, and then transferred from the cooling section (93). The water vapor generated by evaporation passes through the tubular member (94) and is released to the outside air sucked by the fan (96).

Behavior in Operation

The first cooling operation is performed in the summer in which the system is under relatively large cooling load. In the first cooling operation, the heat exhaust side three-way valve (83) is switched to the position to communicate with the condenser (15), the first heat utilization side three-way valve (84) is switched to the position to communicate with the evaporator (11), and the second heat utilization side three-way valve (85) is switched to the position to communicate with the evaporator (11). Under these conditions, in the heat utilization side circuit (30), the circulating pump (31) is operated to circulate the heat transfer water between the evaporator (11) and the heat utilization side heat exchanger (32). Then, the heat transfer water cooled in the evaporator (11) is supplied to the heat utilization side heat exchanger (32) to cool the room air. In other words, the room air is cooled with the heat transfer water at relatively low temperature (for example, approximately 7° C.) cooled by the evaporator (11). On the other hand, in the heat exhaust side circuit (35), the circulating pump (36) is operated to circulate the cooling water between the condenser (15) and the cooling tower (90). Then, the cooling water cooled in the cooling tower (90) is supplied to the condenser (15) to process heat of condensation of the water vapor.

The second cooling operation is made in the middle seasons when the system is under relatively small cooling load. In the second cooling operation, the heat exhaust side three-way valve (83) is switched to the position to communicate with the first pipe (81), the first heat utilization side three-way valve (84) is switched to the position to communicate with the first pipe (81), and the second heat utilization side three-way valve (85) is switched to the position to communicate with the second pipe (82). Under these conditions, the circulating pump (36) is operated to circulate the heat transfer water between the cooling tower (90) and the heat utilization side heat exchanger (32). The circulating pump (31) and the compressor (21) are not operated. The heat transfer water cooled in the cooling tower (90) is given a circulating force by the circulating pump (36), and thereby pumped through the first pipe (81) to the heat utilization side heat exchanger (32). In the heat utilization side heat exchanger (32), the room air is cooled by the heat transfer water sent from the cooling tower (90). The heat transfer water which has been heat exchanged with the room air in the heat utilization side heat exchanger (32) is sent to the cooling tower (90) and cooled therein again. The heat transfer water repeats this circulation. Accordingly, since in the middle seasons, the system is under relatively small load and the outside air temperature is not so high, sufficient cooling can be provided by cooling the heat transfer water with the use of only the cooling tower (90).

Effects of Embodiment 6

In Embodiment 6, the first and second cooling operations are selectively performed in accordance with the change in cooling load. Accordingly, an optimal operation according to the cooling load can be effected, which enhances energy efficiency while ensuring comfortableness of the people in the room.

Further, in this embodiment, water vapor is released in the cooling tower (90) through the tubular member (94) formed of a moisture permeable membrane. Therefore, the heat transfer water and the outside air are never in direct contact with each other unlike a common cooling tower (90) of so-called open type, and therefore the heat transfer water can be prevented from being contaminated. As a result, maintenance can be facilitated and the system performance can be avoided from being deteriorated due to contamination of the pipes, the heat utilization side heat exchanger (32) and the like.

<<Seventh Embodiment>>

Embodiment 7 of the present invention uses as a heat pump the refrigeration system (10) according to the present invention.

Figure 10:
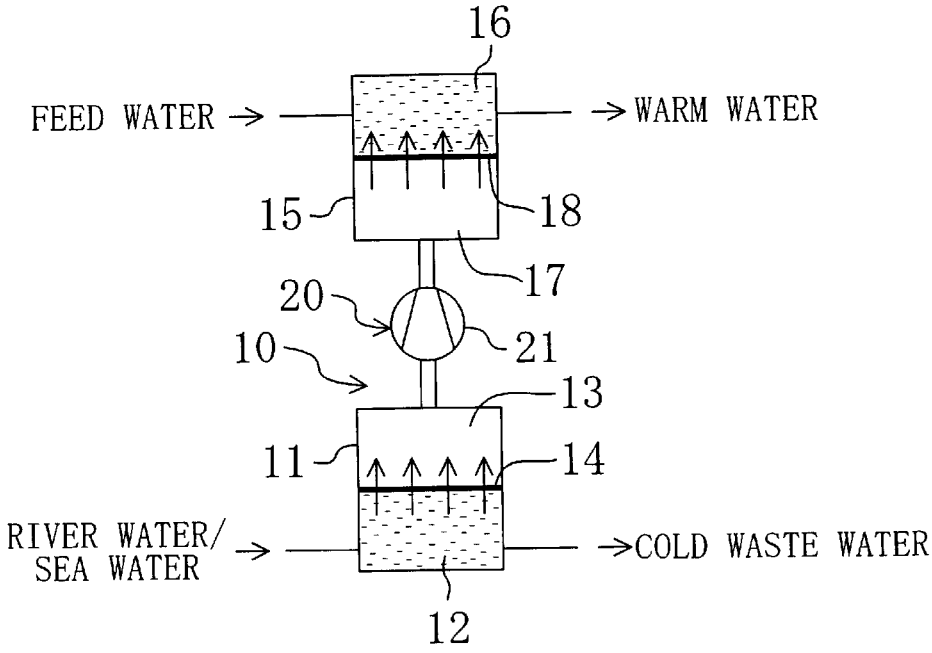
FIG. 10 is a schematic diagram of the structure of a refrigeration system according to Embodiment 7.

As shown in FIG. 10, the refrigeration system (10) of the present invention is constructed, like Embodiment 1, to include the evaporator (11), the condenser (15) and the compressor (21). Also, the evaporator (11) and the condenser (15) are each formed of a container-like member (55) like Embodiment 1.

The liquid side space (12) of the evaporator (11) is fed with a river water or sea water as a heat source water. Water vapor provided by evaporation of the heat source water in the evaporator (11) is supplied to the condenser (15) by the compressor (21). On the other hand, the heat source water from which latent heat of evaporation has been taken in the evaporator (11) is discharged, at a low temperature, from the evaporator (11).

The liquid side space (16) of the condenser (15) is fed with a city water as a heat transfer water. The heat transfer water of the condenser (15) is heated by absorbing heat of condensation of the water vapor supplied from the evaporator (11). A warm water provided by heat application to the heat transfer water is discharged from the condenser (15) and used for heating or the like.

In this embodiment, the moisture permeable membrane (18) is used in the condenser (15) to bring the water vapor into direct contact with the heat transfer water in the liquid side space (16). Accordingly, as compared with the case where heat exchange is made between the heat transfer water and the water vapor through a heat transfer pipe or the like as in the prior art, this embodiment can reduce heat loss during heat exchange thereby enhancing energy efficiency.

Further, this embodiment uses as the evaporator (11) not a metallic heat transfer pipe but a resin-made moisture permeable membrane (14). Therefore, the river water or the sea water can be used as a heat source water while the problem of corrosion of the heat transfer pipe and the like can be avoided.

Modified Form of Embodiment 7

Figure 11:
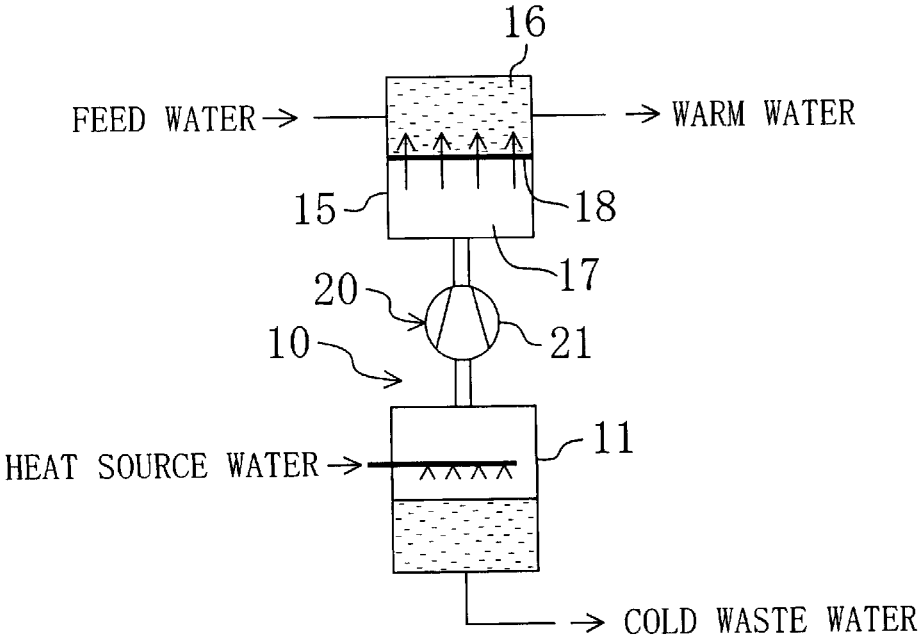
FIG. 11 is a schematic diagram of the structure of a refrigeration system according to a modified form of Embodiment 7.

In Embodiment 7, the evaporator (11) and the condenser (15) are each formed of a container-like member (55). Alternatively, as shown in FIG. 11, only the condenser (15) may be formed of a container-like member (55). In this case, the city water is used as a heat source water, and the heat source water is heat exchanged with the river water or the sea water and then spread into the evaporator (11). The water vapor provided by evaporation of the heat source water is sent to the condenser (15), while the heat source water from which latent heat of evaporation was taken is raised in pressure and discharged to the outside by an unshown pump.

<<Other Embodiments>>

First Modification

Figure 12:
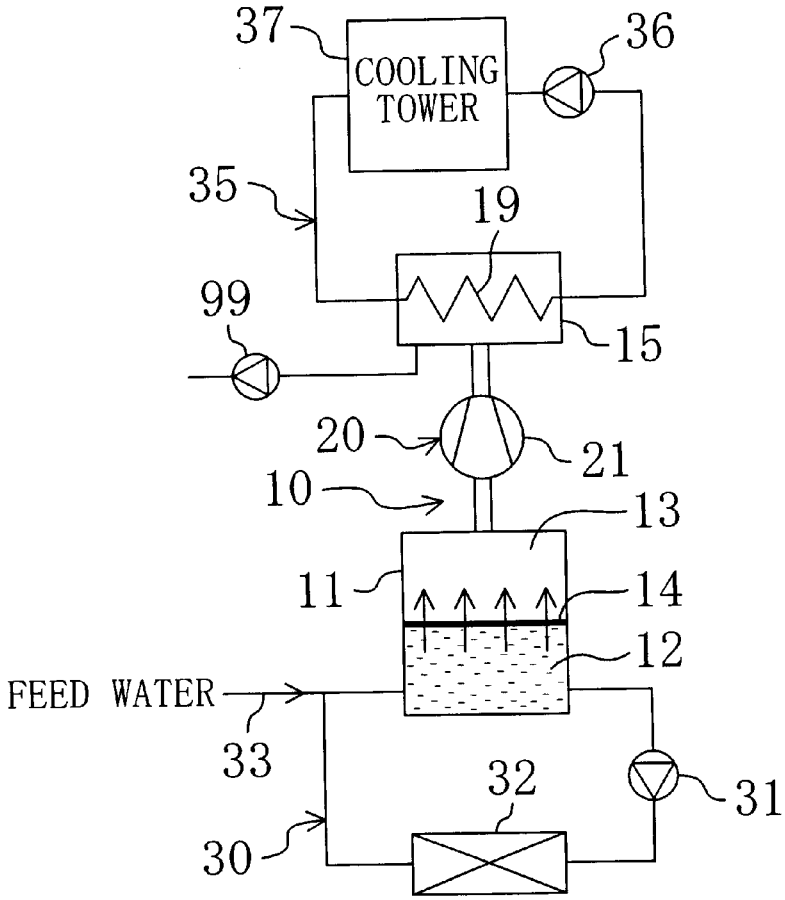
FIG. 12 is a schematic diagram of the structure of an air conditioner according to another embodiment (a first modification).

In Embodiment 1, the evaporator (11) and the condenser (15) are each formed of a container-like member (55). Alternatively, as shown in FIG. 12, only the evaporator (11) may be formed of a container-like member (55). In this case, a heat transfer pipe (19) is provided in the condenser (15), and a cooling water is channeled through the pipe to condensate water vapor outside of the pipe. Water produced by condensation in the condenser (15) is raised in pressure and discharged by a discharge pump (99). The water discharged from the condenser (15) may be returned to the liquid side space (12) of the evaporator (11) to reduce the amount of water fed into the evaporator (11).

Second Modification

Figure 13:
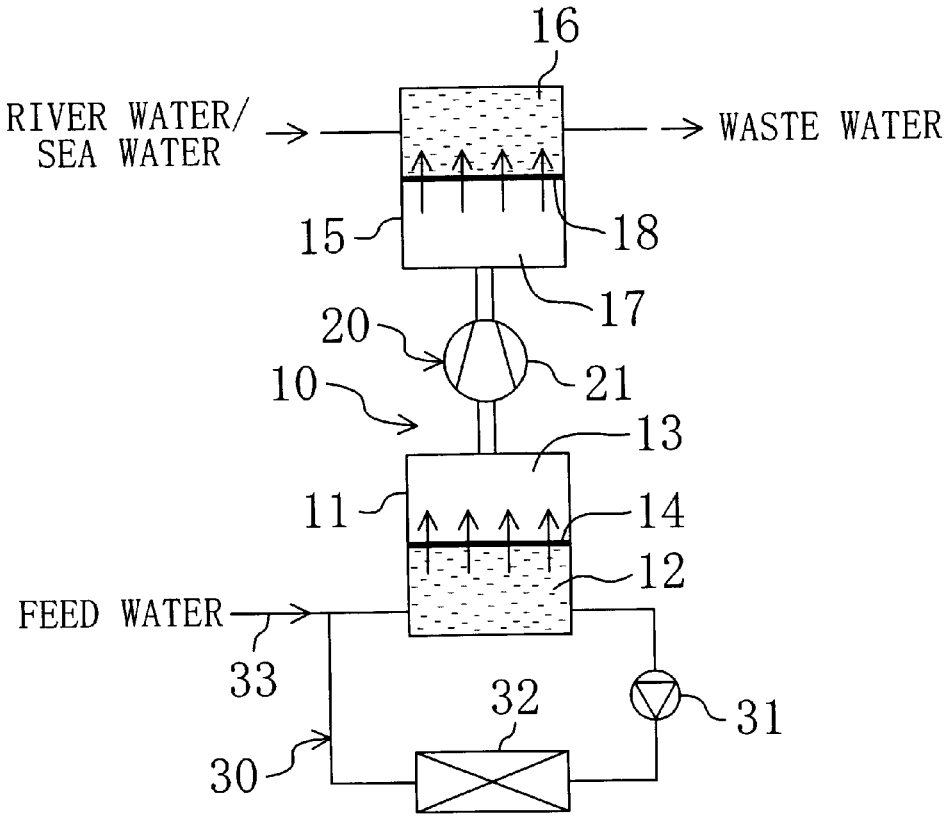
FIG. 13 is a schematic diagram of the structure of an air conditioner according to still another embodiment (a second modification).

In Embodiment 1, the condenser (15) is connected to the heat exhaust side circuit (35) and the cooling water is used to process heat of condensation of water vapor. Alternatively, as shown in FIG. 13, the river water or the sea water may be circulated through the liquid space (16) of the condenser (15) so that heat of condensation of water vapor may be released to the river water or the sea water.

Third Modification

Figure 14:
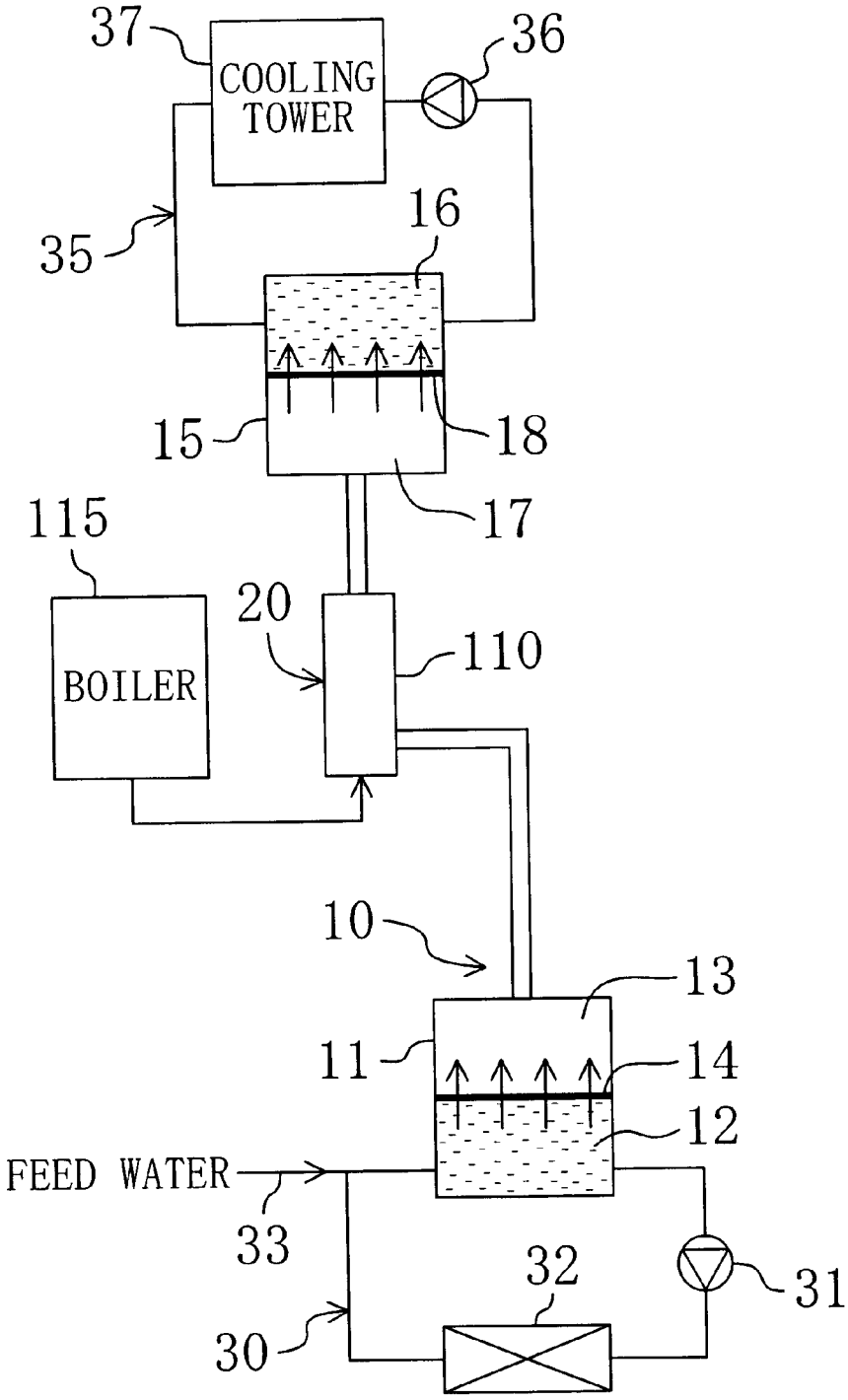
FIG. 14 is a schematic diagram of the structure of an air conditioner according to still another embodiment (a third modification).

In each of the above embodiments, the evacuating means (20) is constituted by the compressor (21) or the heat absorption side circuit (40). Alternatively, the evacuating means (20) may be constituted by a boiler (115) as a water vapor generating means and an ejector (110). Below, the construction of a booster means in this modification will be described with reference to FIGS. 14 and 15. It is to be noted that FIG. 14 illustrates the case where the evacuating means (20) in this modification is applied to Embodiment 1 (see FIG. 1).

The boiler (115) is arranged to apply heat to water thereby generating water vapor. The boiler (115) supplies water vapor to the ejector (110). In this case, the pressure of water vapor generated by the boiler (115) is set higher than that of water vapor in the gas side space (17) of the condenser (15).

Figure 15:
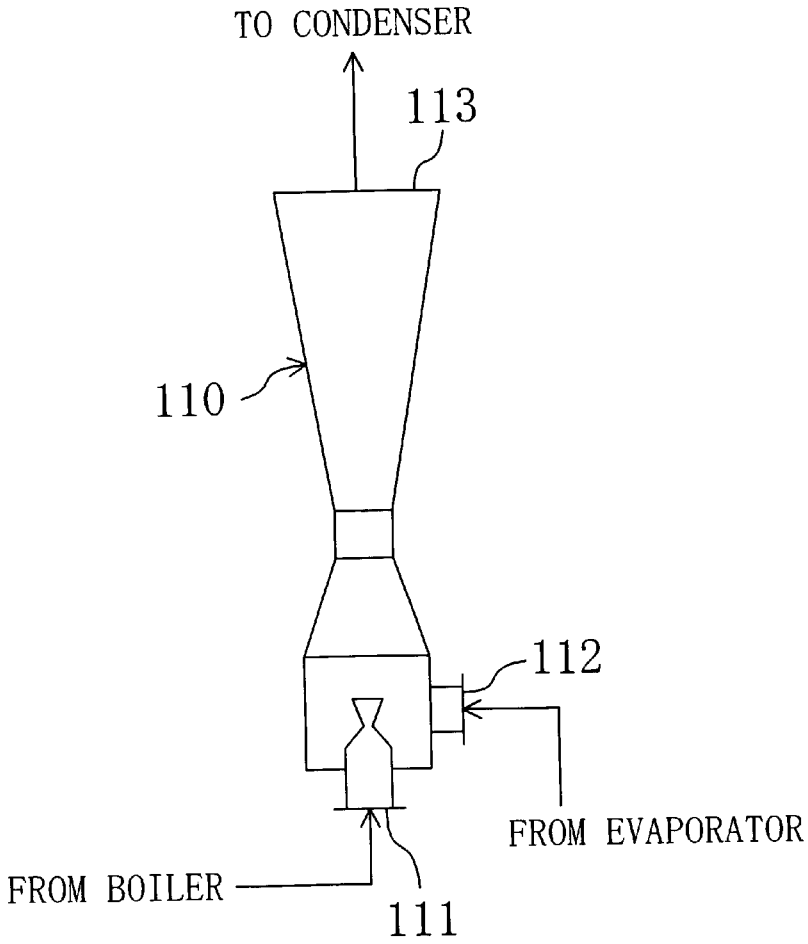
FIG. 15 is a schematic diagram of the structure of an ejector according to said still another embodiment (the third modification).

As shown in FIG. 15, the ejector (110) is configured in tubular shape. The ejector (110) has an admission port (111) formed in the end surface thereof located in an end portion thereof, and a suction port (112) formed in the side surface in the end portion. Also, the ejector (110) has a discharge port (113) opening into the other end surface. Further, the ejector (110) is configured so that its diameter is reduced from one end toward the other end and then increased.

The ejector (110) is connected at the admission port (111) with the boiler (115), connected at the suction port (112) with the gas side space (13) of the evaporator (11) and connected at the discharge port (113) with the gas side space (17) of the condenser (15). Also, the ejector (110) emits water vapor, which has been supplied therein through the admission port (111), as a steam jet at a high speed, and sucks water vapor through the suction port (112) under the action of the jet. Further, in the ejector (110), the water vapor sucked from the gas side space (13) of the evaporator (11) and the water vapor supplied from the boiler (115) are converged and the converged water vapor is pumped from the discharge port (113) into the gas side space (17) of the condenser (15).

With the above arrangement, this modification enables the refrigeration system (10) to run by generation of water vapor in the boiler (115). In other words, the refrigeration system (10) can be operated by heat alone without using electric power.

Fourth Modification

In Embodiments 1 to 6, the air conditioner is arranged so that the object to be cooled of the refrigeration system (10) is a room air. The object to be cooled, however, is not limited to the room air but the system can be used for cooling various kinds of machines.

Fifth Modification

In each of the above embodiments, the city water is used as a heat transfer water. Alternatively, a water solution such as an antifreezing solution may be used.

Industrial Applicability

As can be seen from the above, the refrigeration system of this invention is useful for air conditioners and the like and in particular, is suitable for using phase changes of water to provide a cooling operation or a heat pumping operation.

What is claimed is:

1. A refrigeration system for cooling a heat transfer medium by evaporating water of the heat transfer medium in an evaporator (11), the system comprising:

the evaporator (11) which is formed of a container-like member (55) having an inner space divided into a liquid side space (12) and a gas side space (13) by a moisture permeable membrane (14) capable of permeating water vapor, the liquid side space (12) being filled with the heat transfer medium which is water or water solution; and evacuating means (20) for evacuating from the gas side space (13) water vapor which has been provided by evaporation of water from the heat transfer medium in the liquid side space (12) of the evaporator (11) and has moved to the gas side space (13), and for holding the gas side space (13) into a predetermined reduced-pressure condition; and a condenser (15) which is formed of a container-like member (55) and arranged to allow the water vapor evacuated from the evaporator (11) by the evacuating means (20) to flow into a gas side space (17) thereof and then move from the gas side space (17) to a heat transfer medium with which a liquid side space (16) thereof is filled.

2. A refrigerating system comprising:

an evaporator (11) in which a heat transfer medium of water or water solution is stored;

evacuating means (20) for evacuating water vapor provided by evaporation of water from the heat transfer medium inside of the evaporator (11) and for holding the evaporator (11) in a predetermined reduced-pressure condition; and a condenser (15) formed of a container-like member (55) an inner space of which is divided into a liquid side space (12) and a gas side space (13) by a moisture permeable membrane (14) capable of permeating water vapor, the condenser (15) being arranged to move the water vapor admitted into a gas side space (17) thereof by the evacuating means (20) to a heat transfer medium with which a liquid side space (16) thereof is filled.

3. The refrigeration system of claims 1 or 2, wherein the system is arranged to effect a heat pumping operation of using heat released from the water vapor in the condenser (15) to heat the heat transfer medium.

4. The refrigeration system of claims 1 or 2, wherein the evacuating means (20) comprises a compressor (21) for compressing the water vapor sucked from the evaporator (11) and pumping the water vapor into the condenser (15).

5. The refrigeration system of claims 1 or 2, wherein the evacuating means (20) is arranged to comprise an absorbing medium for absorbing and releasing moisture, allow the absorbing medium to absorb the water vapor from the evaporator (11), and send into the condenser (15) the water vapor released from the absorbing medium.

6. The refrigeration system of claims 1 or 2, wherein the evacuating means (20) comprises water vapor generating means (115) for generating water vapor through the application of heat and an ejector (110) for ejecting water vapor from the evaporator (11) under the action of a jet of the water vapor generated by the water vapor generating means (115).

7. The refrigeration system of claims 1 or 2, wherein the container-like member (55) contains a multiplicity of moisture permeable tubes (60) each formed of a moisture permeable membrane (14, 18), the inside of the moisture permeable tube (60) is formed into a liquid side space (12, 16) and the outside of the moisture permeable tube, (60) is formed into a gas side space (13, 17).

8. The refrigeration system of claims 1 or 2, wherein the moisture permeable membrane (14, 18) in the container-like member (55) has a surface which is presented to the gas side space (13, 17), and covered with a porous film (61).

9. The refrigeration system of claims 1 or 2, wherein the moisture permeable membrane (14, 18) in the container-like member (55) has water repellency.

10. The refrigeration system of claims 1 or 2, wherein the evaporator (11) is arranged to cool the heat transfer medium to generate a frozen product slurry.

11. A refrigeration system for cooling a heat transfer medium by evaporating water of the heat transfer medium in an evaporator (11), the system comprising:

the evaporator (11) which is formed of a container-like member (55) having an inner space divided into a liquid side space (12) and a gas side space (13) by a moisture permeable membrane (14) capable of permeating water vapor, the liquid side space (12) being filled with the heat transfer medium which is water or water solution; and evacuating means (20) for evacuating from the gas side space (13) water vapor which has been provided by evaporation of water from the heat transfer medium in the liquid side space (12) of the evaporator (11) and has moved to the gas side space (13), and for holding the gas side space (13) into a predetermined reduced-pressure condition, wherein the evaporator (11) is arranged to cool the heat transfer medium to generate a frozen product slurry.

12. The refrigeration system of claims 1 or 2, wherein the system is arranged to include a heat storage tank (67) and effect a heat storage operation of storing in the heat storage tank (67) the heat transfer medium cooled by the evaporator (11) and a heat utilization operation of cooling the heat transfer medium in the evaporator (11) and supplying to the condenser (15) the heat transfer medium stored in the heat storage tank (67) through the heat storage operation to condense water vapor.

13. The refrigeration system of claims 1 or 2, further comprising: a heat storage tank (67) connected to the evaporator (11) to allow the heat transfer medium to circulate between the evaporator (11) and the heat storage tank (67); and heat utilization means (32) to which the heat transfer medium is supplied from the evaporator (11), wherein the system is arranged to effect a heat storage operation of storing in the heat storage tank (67) the heat transfer medium cooled by the evaporator (11) and a heat utilization operation of supplying to the evaporator (11) the heat transfer medium stored in the heat storage tank (67) through the heat storage operation and supplying to the heat utilization means (32) a frozen product slurry produced by cooling the heat transfer medium.

14. The refrigeration system of claims 1 or 2, further comprising: a heat utilization side heat exchanger (32) for heat exchanging the heat transfer medium with an object to be cooled; and a cooling tower (90) for cooling the heat transfer medium, wherein the system is arranged to effect a first cooling operation of circulating the heat transfer medium between the cooling tower (90) and the condenser (15), circulating the heat transfer medium between the heat utilization side heat exchanger (32) and the evaporator and operating the evacuating means (20) and effect a second cooling operation of circulating heat transfer medium between the cooling tower (90) and the heat utilization side heat exchanger (32) and stopping the evacuating means (20).

15. The refrigeration system of claims 10 or 11, wherein the system is arranged to include a heat storage tank (67) and effect a heat storage operation of storing in the heat storage tank (67) the frozen product generated by the evaporator.

16. A refrigeration system for cooling a heat transfer medium by evaporating water of the heat transfer medium in an evaporator (11), the system comprising:

the evaporator (11) which is formed of a container-like member (55) having an inner space divided into a liquid side space (12) and a gas side space (13) by a moisture permeable membrane (14) capable of permeating water vapor, the liquid side space (12) being filled with the heat transfer medium which is water or water solution; and evacuating means (20) for evacuating from the gas side space (13) water vapor which has been provided by evaporation of water from the heat transfer medium in the liquid side space (12) of the evaporator (11) and has moved to the gas side space (13), and for holding the gas side space (13) into a predetermined reduced-pressure condition; and a heat storage tank (67) connected to the evaporator (11) to allow the heat transfer medium to circulate between the evaporator (11) and the heat storage tank (67); and heat utilization means (32) to which the heat transfer medium is supplied from the evaporator (11), wherein the system is arranged to effect a heat storage operation of storing in the heat storage tank (67) the heat transfer medium cooled by the evaporator (11) and a heat utilization operation of supplying to the evaporator (11) the heat transfer medium stored in the heat storage tank (67) through the heat storage operation and supplying to the heat utilization means (32) a frozen product slurry produced by cooling the heat transfer medium.

* * * * *